United States Patent [19]

Weingartner

[11] 4,145,566

[45] Mar. 20, 1979

[54] HOUSING FOR ELECTRICAL DEVICES

[75] Inventor: Bernhard Weingartner, Feldkirch-Tosters, Austria

[73] Assignee: Neutrik Aktiengesellschaft, Schaan, Liechtenstein

[21] Appl. No.: 734,548

[22] Filed: Oct. 21, 1976

[30] Foreign Application Priority Data

Oct. 23, 1975 [AT] Austria ..... 8112/75

[51] Int. Cl.[2] ..... H01R 13/58

[52] U.S. Cl. ..... 174/65 R; 24/136 B; 339/103 R

[58] Field of Search ..... 174/65 R, 65 SS, 135; 339/103 R, 103 B, 103 C, 103 M, 107; 279/28, 29, 1 SG; 24/136 B

[56] References Cited

U.S. PATENT DOCUMENTS

| | | | |
|---|---|---|---|
| 3,614,140 | 10/1971 | Nestor | 24/136 B |
| 3,667,783 | 6/1972 | Sotolongo | 174/65 SS |
| 3,744,008 | 7/1973 | Castellani | 174/65 SS |

FOREIGN PATENT DOCUMENTS

| | | | |
|---|---|---|---|
| 683863 | 11/1939 | Fed. Rep. of Germany. | |
| 1088126 | 9/1960 | Fed. Rep. of Germany. | |
| 1145684 | 3/1963 | Fed. Rep. of Germany. | |
| 2313198 | 9/1973 | Fed. Rep. of Germany | 339/103 R |
| 860550 | 9/1940 | France. | |

*Primary Examiner*—J. V. Truhe
*Assistant Examiner*—D. A. Tone
*Attorney, Agent, or Firm*—Hans Berman

[57] ABSTRACT

A housing for an electric plug or the like is formed with an axial bore which tapers toward an inlet opening. A pressure member received in the bore for movement toward and away from the inlet opening in conforming engagement with the housing has a face which radially approaches a counter face in the bore for clamping a cable therebetween during axial movement of the pressure member toward the inlet opening. A tubular clamping member, substantially coaxial with the bore of the housing, carries threads matingly engaging threads on the pressure member about the axis. An abutment of the clamping member engages an external rim portion of the housing about the inlet opening and limits threaded movement of the clamping member inward of the bore, whereby the pressure member is moved axially toward the inlet opening, and a cable passing through the tubular clamping member into the bore of the housing is clamped between the face of the pressure member and the counter face.

8 Claims, 9 Drawing Figures

FIG. 2
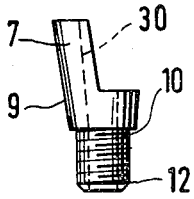
FIG. 1
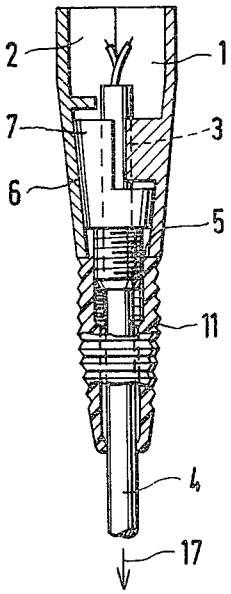
FIG. 5
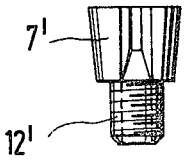
FIG. 3
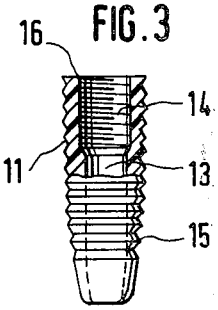
FIG. 7
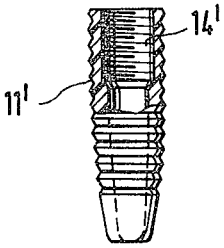
FIG. 6
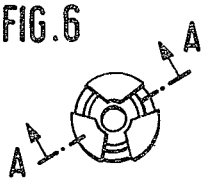
FIG. 4
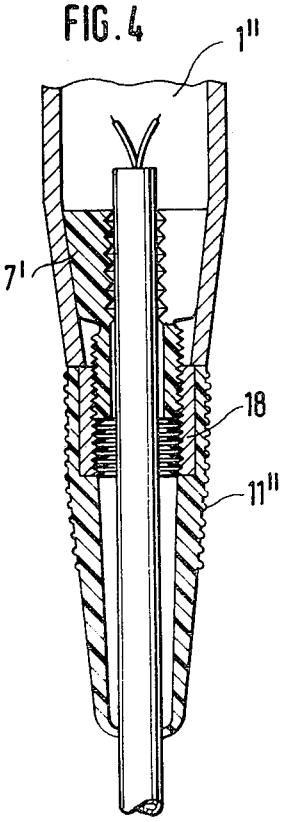
FIG. 8
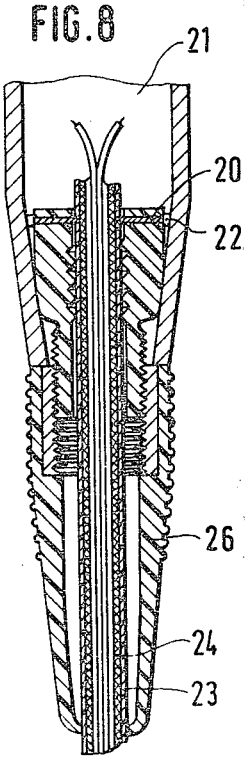
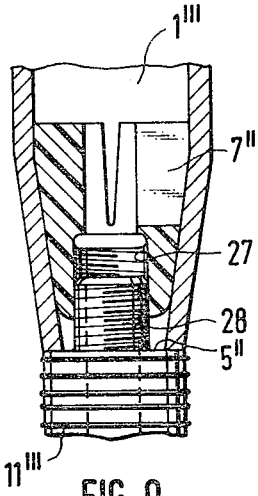
FIG. 9

HOUSING FOR ELECTRICAL DEVICES

The invention relates to a housing or housing element for electrical or electrically operated devices and contact elements, for example, for switches, sockets, microphones, motors, plugs, couplings and the like.

The cable inlet into a housing of an electrically operated device or a plug-in connector is usually provided with a tension relieving device because the cable is subjected both to tensional stresses and to flexural stresses at the inlet. This is the case particularly in a plug-in connection, between two electrical structural elements, devices, and the like in which alternating stresses may quickly cause damage to the cable or even its destruction.

Structural solutions of the problem of tension relief have become known in large numbers. It is their function to transmit tensional forces acting on the cable or the line directly to the housing.

It is the object of this invention to improve the known cable inlet arrangements and particularly the tension relief means in such arrangement, to make such tension relief means of simple structure easy to assemble, and further to design them in such a manner that they can accomplish their task without damaging or endangering the cable. This is achieved according to the invention by a pressure element having an extension carrying internal or external threads into or on which a clamping element passed by the cable to be received may be screwed, the clamping element abutting against the outer rim of the inlet opening of the housing or housing element. Because of this feature, when the clamping element is tightened, the pressure element which engages the cable under only low pressure over a large contact area is subjected to a transverse shift against the cable in the manner of a wedge or of clamping tongs. The pressure element may be made of rigid material or of elastically deformable material. Because the clamping element is threadedly attachable, the device can also be assembled or disassembled without tools. The contact pressure transmitted by the pressure element to the cable is capable of precise dosing by means of the manually screwed clamping element. An internal face of the housing or an insert capable of being positioned in the housing may provide a counter face.

Embodiments of the invention will be described with reference to the drawing wherein:

FIG. 1 shows a longitudinal section of a cable inlet in a two-part plug housing;

FIG. 2 illustrates the pressure element thereof and

FIG. 3 the clamping element constituted by a cable bushing;

FIG. 4 shows a second embodiment of the invention in longitudinal section and having a circumferentially closed housing;

FIGS. 5 and 6 illustrate the pressure element out of FIG. 4 in elevation and in top plan view respectively, and FIG. 7 shows the cable bushing constituting a clamping element; and FIGS. 8 and 9 illustrate additional embodiments of the invention in longitudinal sections.

In FIG. 1, there is shown a cable inlet into a plug housing in longitudinal section. The plug housing consists of the two housing shells 1, 2 fixedly connected to each other in a suitable manner. The specific way in which the ends of the cable 4 are connected with the contact elements in the plug housing is not shown here nor in the drawing figures described below because the configuration of the contact elements of the plug has no direct bearing on the invention. The inner sides of the two housing shells 1, 2 are differently shaped. The housing shell 1 carries an internal rib 3 formed with a cylindrically arcuate groove which may carry an anti-slip coating or have a rough, for example, a serrated, surface. The circumferential dimension of this groove is smaller than one half of the circumference of cable 4. The other housing shell 2 has, opposite the receiving surface of the rib 3, an oblique face 6 tapering toward the inlet opening 5 of the housing, the face 6 being shaped as the surface of a wedge or of a cone. A pressure element 7 engages this oblique face 6 and has the shape of a prismatic or conical body whose outer bounding surface 9 directed away from the cable 4 is shaped to correspond to the inner oblique face 6 of the housing shell 2. The side of the pressure element 7 directed toward the cable 4 preferably has a trough-shaped, longitudinal recess 30 for receiving the cable 4. The pressure element consists of an elastically deformable material. A threaded extension 12 is provided at the underside 10 of the pressure element 7 and preferably forms a unitary body with the pressure element 7. The trough-shaped longitudinal recess 30 of the pressure element 7 merges near the bottom end of the pressure element into a circumferentially closed duct passing through the threaded extension. When properly assembled (FIG. 1), the threaded extension is passed through by the cable 4. The cable bushing 11 shown in FIG. 3 secures the pressure element 7 in the housing. The cable bushing 11 has a duct 13 for passage of the cable which has female threads 14. These threads may be formed directly in the material of the bushing 11, but it is also possible optionally to insert a screw socket. The outer face 15 of the cable bushing may be grooved or corrugated.

During assembly, the pressure element 7 receiving the cable 4 is placed in the housing shells 1, 2 so that the threaded extension 12 projects at least to some small extent from the inlet opening 5 of the housing. The housing halves then are connected with each other, as by screws. Thereafter, the cable bushing 11 which was slipped over the cable 4 prior to assembly of the housing is screwed on the projecting threaded extension until the front face 16 of the bushing abuts against the rim of the inlet opening 5 of the housing (FIG. 1). The rib 3 limits angular movement of the pressure element 7, and the pressure element is shifted axially by turning of the cable bushing which acts as a clamping element, whereby the pressure element 7 is pressed against the cable, the cable being engaged under clamping pressure acting on a large area by the resulting wedge effect. The clamping pressure increases with increasing tensioning force acting on the threaded extension. Such a tensioning force may be generated when the cable 4 is pulled in the direction of the arrow 17 or when the bushing 11 is tightened more strongly.

An advantageously shaped pressure element 7' has several, preferably three, jaws acting in the manner of a collet, and such a pressure element is shown in elevation in FIG. 5, and in plan view in FIG. 6. The pressure element 7' also has a threaded extension 12'. The cable bushing 11' capable of being clamped thereby (FIG. 7) corresponds substantially to the cable bushing shown in FIG. 3. Here too, the internal threads 14' may be formed directly in the material of the bushing or formed in an inserted screw socket.

FIG. 4 shows the pressure element 7' installed in a unitary housing 1'' which is axially symmetrical. The bushing 11'' shown in this embodiment has an inserted screw socket 18. The cooperation of these individual parts is evident from what has been stated above with reference to FIGS. 1 to 3. The longitudinal section according to FIG. 4 is taken on the line A—A in FIG. 6. FIGS. 5 and 6 show the pressure element 7' have three frustoconical clamping segments which are deflected radially when sliding up on the inner oblique face of the plug housing 1'', whereby the desired clamping effect on a cable is achieved. The pressure element 7' is shifted axially, as explained above, by threaded tightening of the cable bushing 11''.

The illustrated saw-tooth-like ribs of the pressure element 7' which is made preferably of hard rubber or a rubber-like elastomer, decreased in flexural rigidity along the pressure element and can thus be matched to the flexural rigidity of the cable.

FIG. 8 illustrates an additional embodiment of the invention which is employed for the tension relief of shielded cables in a particularly advantageous manner. When shielded cables, as particularly used in electroaccustic devices, are to be connected electrically with corresponding contact pins of plugs, connecting a shielding braid with the plug housing or the corresponding grounding contact is awkward and time consuming, and the individual loose wires of the braid constitute an ever-present hazard of undesired short circuits or shunts. According to the invention, the electrical connection from the cable shield to an electrically conductive plug housing is achieved in a simple, yet reliable manner by a radially extending, electrically conductive peg or pin 20 passing through the pressure element or the jaws constituting the pressure element. A point of the pin projects beyond the inner bounding surface of the pressure element or the jaws and a contact piece 22 of the pin establishes an electrical connection with the inner wall of the housing 21. The inner, pointed end of this peg or contact pin penetrates the outer envelope 23 of the cable and establishes contact with the shielding braid 24. The outer end or contact piece 22 abuts conductively against the inner wall of the plug housing 21. The structures of the pressure element and of the bushing 26 clamped thereby correspond to the structures of FIGS. 5 and 7. During the assembly of the parts, the required and desired electrical contact is established automatically. The cable is pulled first into the extension of the pressure element, and the housing thereafter is pushed and pulled thereover. During threaded fastening of the bushing, the metallic, electrically conductive pin 20 pierces the cable envelope 23 and establishes contact with the shielding braid 24. Care has to be taken that the electrically conductive contact pin or contact peg 20 projects no farther beyond the inner face of the pressure element or the jaws of the pressure element than corresponds to the wall thickness of the cable envelope and the shielding braid. Band-shaped contact elements, for example, may be employed instead of pin-shaped contact elements. It is a particular advantage of this arrangement that the cable envelope and cable shield may be removed flush with each other, and the cable strands only need to be connected with corresponding contact pins or other contact elements arranged in the housing 21.

An additional embodiment is shown in FIG. 9 in longitudinal section. The pressure element 7'' consists again of several jaws cooperating in the manner of a collet, an internally threaded passage 27 being provided in the portion of the pressure element 7'' directed toward the inlet opening 5'' of the associated housing 1'''. A threaded extension 28 provided on a cable bushing 11''' may be screwed into the passage 27. When the cable bushing 11''', which abuts against the rim of the inlet opening 5'' is turned, the clamping element is pulled axially toward the bushing, the jaws of the pressure element 7'' being shifted radially by the oblique face of the housing 1'''.

The advantages of the invention reside in outstanding tension relief and negligible compressive stressing of the cable because the clamping forces attack large areas of the cable. The clamping force is self-reinforcing because the resistance to withdrawal of the cable increases when the tension applied to the cable increases. The structure is simple, low in cost and particularly easy to assemble. The arrangement can compensate for relatively great differences in cable diameter so that the same device may be employed for cables of different diameters. The tension relief device also may be installed and removed without requiring special tools.

I claim:

1. In an electrical device, in combination:

(a) a housing having an axis and being formed with an axially elongated bore,
  (1) said housing having an external rim portion defining an inlet opening of said bore,
  (2) said bore axially tapering toward said inlet opening;

(b) a pressure member received in said bore for movement toward and away from said inlet opening in conforming engagement with said housing;

(c) counter face means in said bore, said pressure member having an axially extending face radially approaching said counter face means for clamping a cable therebetween during said axial movement of said pressure member toward said inlet opening;

(d) a tubular clamping member substantially coaxial with said bore,
  (1) thread means on said clamping member about said axis matingly engaging corresponding threads on said pressure member,
  (2) said clamping member carrying abutment means axially engageable with said rim portion for limiting threaded movement of the clamping member inward of said bore,
  (3) whereby a cable passing through said tubular clamping member into said bore may be clamped between said face and said counter face means by threadedly moving said clamping member on said pressure member while said abutment means engage said rim portion; and (e) rib means on said housing in said bore for limiting angular movement of said pressure member about said axis.

2. In a device as set forth in claim 1, said threads on said clamping member being female threads, a portion of said pressure member being formed with an axial passage and threadedly engaging said female threads.

3. In a device as set forth in claim 2, said portion of said pressure member axially projecting from said inlet opening outward of said bore.

4. In a device as set forth in claim 3, another portion of said pressure member engaging said housing in said bore and carrying said axially extending face, said other portion consisting essentially of resiliently deformable material.

5. In a device as set forth in claim 4, said counter face means being fixedly fastened to said housing in said bore, at least one of said counter face means and said face being formed with an axial groove opposite the other one of said counter face means and said face.

6. In a device as set forth in claim 1, said thread means including a threaded member mounted on said clamping member.

7. In an electrical device, in combination:

(a) a housing having an axis and being formed with an axially elongated bore,
  (1) said housing having an external rim portion defining an inlet opening of said bore,
  (2) said bore axially tapering toward said inlet opening;

(b) a pressure member having a first portion received in said bore for movement toward and away from said inlet opening in conforming engagement with said housing and a second portion axially projecting from said housing;

(c) counter face means in said bore,
  (1) said first portion consisting essentially of resiliently deformable material and having an axially extending face radially approaching said counter face means for clamping a cable therebetween during said axial movement of said pressure member toward said inlet opening;

(d) a tubular clamping member substantially coaxial with said bore,
  (1) thread means on said clamping member about said axis matingly engaging corresponding threads on said second portion,
  (2) said clamping member carrying abutment means axially engageable with said rim portion for limiting threaded movement of the clamping member inward of said bore,
  (3) whereby a cable passing through said tubular clamping member into said bore may be clamped between said face and said counter face means by threadedly moving said clamping member on said pressure member while said abutment means engage said rim portion; and (e) an elongated, electrically conductive member radially passing through said first portion of the pressure member,
  (1) respective longitudinal end portions of said conductive member projecting from said first portion toward said counter face means and toward said housing respectively,
  (2) a portion of said housing being engaged by one of said end portions when said cable is clamped between said face and said counter face means, said portion of the housing being electrically conductive.

8. In an electrical device, in combination:

(a) a housing having an axis and being formed with an axially elongated bore,
  (1) said housing having an external rim portion defining an inlet opening of said bore,
  (2) said bore axially tapering toward said inlet opening;

(b) a pressure member received in said bore for movement toward and away from said inlet opening in conforming engagement with said housing, said pressure member being formed with an axial passage;

(c) counter face means in said bore, said pressure member having an axially extending face radially approaching said counter face means for clamping a cable therebetween during said axial movement of said pressure member toward said inlet opening; and (d) a tubular clamping member substantially coaxial with said bore,
  (1) male threads on said clamping member about said axis matingly engaging corresponding threads in said axial passage of said pressure member,
  (2) said clamping member carrying abutment means axially engageable with said rim portion for limiting threaded movement of the clamping member inward of said bore,
  (3) whereby a cable passing through said tubular clamping member into said bore may be clamped between said face and said counter face means by threadedly moving said clamping member on said pressure member while said abutment means engage said rim portion.

* * * * *